United States Patent [19]

Uno et al.

[11] Patent Number: 4,994,357

[45] Date of Patent: Feb. 19, 1991

[54] PROCESS FOR PRODUCING PHOTOGRAPHIC SUPPORT

[75] Inventors: Akira Uno, Kashiwa; Touru Noda, Matsudo, both of Japan

[73] Assignee: Mitsubishi Paper Mills Limited, Tokyo, Japan

[21] Appl. No.: 360,069

[22] Filed: Jun. 1, 1989

[30] Foreign Application Priority Data

Jun. 1, 1988 [JP] Japan ..... 63-135016

[51] Int. Cl.[5] ..... G03C 1/76

[52] U.S. Cl. ..... 430/536; 427/209; 427/371; 427/398.2

[58] Field of Search ..... 430/532, 536; 427/209, 427/371, 398.2

[56] References Cited

U.S. PATENT DOCUMENTS 3,723,169 3/1973 Guastella et al. ..... 427/398.2
4,133,688 1/1979 Sack ..... 430/536

FOREIGN PATENT DOCUMENTS 55-26507 2/1980 Japan .
58-37642 3/1983 Japan .
59-198451 11/1984 Japan .

*Primary Examiner*—Paul R. Michl
*Assistant Examiner*—Thorl Chea
*Attorney, Agent, or Firm*—Cushman, Darby & Cushman

[57] ABSTRACT

A double-side resin coated photographic support obtained by coating at least one polyolefin resin layer on a photographic emulsion layer side, an outermost polyolefin resin layer having a center line average surface roughness of 1.0 μm or less, and passing the resulting resin coated base sheet between a cooling roll and a back-up roll under a special linear pressure is free from surface defects and excellent in surface smoothness.

7 Claims, No Drawings

PROCESS FOR PRODUCING PHOTOGRAPHIC SUPPORT

BACKGROUND OF THE INVENTION

The present invention relates to a process for producing a photographic support which comprises coating a polyolefin resin on both sides of a paper used as a base sheet (the paper of the base sheet is hereinafter referred to as "base paper"). In particular, it relates to a process for producing a photographic support which is free from surface defects and excellent in surface smoothness.

Photographic supports other than those for photosensitive film materials which have been commonly used are the so-called baryta papers formed by coating a baryta layer comprising mainly barium sulfate on one side of a paper. In recent years, however, with the aim of automation and the rapidity of development operations, water-resistant supports formed by coating both sides of the base paper with polyolefin resin, namely polyolefin resin-coated papers, have been used. However, polyolefin resin-coated paper has a number of problems when used as a photographic support.

In general, photographic polyolefin resin coated-paper is produced by using a melt-extrusion coating method. In this case, the polyolefin resin layer on the side to which a photographic emulsion is to be applied is incorporated with titanium dioxide pigment to improve the sharpness and resolution of photographic images. Production of such a polyolefin resin-coated paper containing titanium dioxide pigment in the resin layer involves various difficulties. First, polyolefin resin layers containing titanium dioxide pigment are highly susceptible to oxidative degradation. Since the decomposition and oxidation products of resin adversely affect on photographic emulsion, extrusion coating needs to be conducted at as low a temperature as possible, which, however, results in very poor adhesion between the base paper and the polyolefin resin layer. Secondly, polyolefin resin incorporated with titanium dioxide is expensive. This is because the cost of titanium dioxide pigment and the expense involved in incorporating the titanium dioxide pigment into the resin are added to the cost of resin. This necessitates reducing the amount of polyolefin resin incorporated with titanium dioxide pigment to be used, which results in the deterioration of sharpness and resolution.

Furthermore, photographic polyolefin resin-coated paper have other problems. Namely, whereas a high level of smoothness is required in a photographic polyolefin resin-coated paper having a glossy surface, the surface smoothness of resin-coated paper is very unsatisfactory particularly when the thickness of the polyolefin resin layer of the photographic emulsion coating side (hereinafter abbreviated as "front side") formed by extrusion-coating a molten polyolefin resin on base paper is 40 μm or less. First, the resin surface of the front side of resin-coated paper has a frizzy, uneven or grainy appearance affected by the texture of base paper, resulting in the deterioration of specular glossiness. Second, pit-formed fine pores develop on the resin surface of the front side of resin-coated paper. Development of such pit-formed fine pores lowers the gloss of the glossy surface of the developed photographic printing paper comprising the resin-coated paper as the support, which greatly lowers the market value of the paper.

With the objective of obviating the various problems and additional difficulties of the photographic polyolefin resin-coated paper mentioned above, methods of double layer extrusion coating based on coextrusion coating or stepwise extrusion coating have been disclosed or exemplified in Japanese Patent Application Kokoku (Post-Exam. Publn.) No. 49-30446 (1974) and Japanese Patent Application Kokai (Laid-Open) Nos. 56-62248 (1981) and 59-198451 (1984). However, these methods are unsatisfactory for solving the above-mentioned problems and, in particular, very unsatisfactory for preventing the development of pit-formed fine pores on the front side of photographic polyolefin resin-coated paper.

SUMMARY OF THE INVENTION

An object of the present invention is to provide a photographic support coated with polyolefin resin on both sides of base paper which is excellent in surface smoothness of the emulsion coating side and, particularly, free from the development of pit-formed fine pores, and a process for producing the photographic support. A further object of the present invention is to provide a photographic polyolefin resin-coated paper which is satisfactory in sharpness and resolution as well as other photographic properties, excellent in surface smoothness and economical efficiency, and a process for producing the same.

According to the present invention, there is provided a process for producing a photographic support which comprises coating one side of a base sheet with a molten polyolefin resin, coating another side of the base sheet with a molten polyolefin resin, and passing the resulting resin-coated base sheet between a cooling roll and a back-up roll under a linear pressure of 30 to 200 kg/cm, a front side of the base sheet on which a photographic emulsion layer is to be formed being coated with at least one polyolefin resin layer, and the outermost polyolefin resin layer having a center line average surface roughness Ra of 1.0 μm or less.

DESCRIPTION OF THE PREFERRED EMBODIMENTS

The center line surface roughness Ra referred to in the present invention is that specified by JIS B 0601 and is the value determined at an effective measuring length of 10 mm after filtering off the surface waviness at a cut-off value of 8 mm specified by JIS B 0601.

In the present invention, the above-stated objects can be achieved by, extrusion-coating the front side resin layer on base paper (or base sheet), coating as the front side resin layer at least two polyolefin layers comprising an outermost resin layer incorporated with 9–20% by weight of titanium dioxide pigment and the other layer(s) by means of stepwise extrusion coating or simultaneous extrusion coating. Particularly, the development of pit-formed fine pores which is apt to occur on the front side resin surface can be markedly prevented. Further, by making the resin layer on the photographic emulsion coating side a double layer, making the center line average roughness of the resin layer 1.0 μm or less, and the linear pressure between the cooling roll and the back-up roll 30 to 200 kg/cm, there can be obtained a resin-coated photographic support wherein the generation of pit-formed fine pores at the outermost surface of the resin-coated base sheet which can be prevented.

Although the polyolefin resin layer of the front side of the photographic support in the present invention may be a single layer, two layers or more than two layers, a two layer structure is preferred for effective achievement of the object of the present invention. The resin layer of a single layer structure or the outermost resin layer in a multilayer structure is incorporated with titanium dioxide pigment. The content of titanium dioxide pigment is in the range of 7–20% by weight, preferably 9–16% by weight. A content of titanium dioxide pigment of less than 7% by weight results in poor sharpness and resolution, whereas a content exceeding 20% by weight results in poor melt-extrusion processability. The thickness of the front side resin layer, or in the case of a multi-layer structure the sum of the thicknesses of the respective front side resin layers, is in the range of 20–45 μm, preferably 24–36 μm. When the thickness of the front side resin layer is less than 20 μm, the resin surface of the front side of a photographic support has a frizzy, uneven or grainy appearance, becomes poor in specular glossiness, and moreover is apt to develop pit-formed fine pores. When the thickness is more than 40 μm, on the other hand, the curling property as a photographic support becomes poor and also such a large thickness is economically disadvantageous. Particularly in the case of a polyolefin resin layer of multilayer structure, the thickness of the outermost resin layer of the front side is 12 μm or more, preferably in the range of 15–35 μm. The thickness less than 12 μm results in poor sharpness and resolution. The thickness of the front side resin layer excluding the outermost resin layer is 10 μm or more, preferably in the range of 12–33 μm. The thickness less than 10 μm tends to cause pit-formed fine pores to develop.

The center line average surface roughness Ra of the front side surface of the photographic support in the present invention is 1.0 μm or less, preferably 0.8 μm or less. When the center line average surface roughness Ra exceeds 1.0 μm, the surface of resin-coated paper has a frizzy, uneven, or grainy appearance, lowers its specular glossiness, and is apt to develop pit-formed fine pores. The center line average surface roughness Ra of the front side surface of polyolefin resin-coated paper can be advantageously reduced to 1.0 μm or less by such means of smoothening the base paper as selection of proper pulp as disclosed or exemplified in Japanese Patent Application Kokai (Laid-Open) Nos. 58-37642 (1983), 60-67940 (1985), 60-69649 (1985) and 61-35442 (1986), adoption of a proper papermaking process as disclosed or exemplified in Japanese Patent Application Kokai (Laid-Open) Nos. 58-37642 (1983), 61-260240 (1986) and 61-284762 (1986), calender processing of base paper as disclosed or exemplified in Japanese Patent Application Kokai (Laid-Open) Nos. 58-37642 (1983) and 60-126397 (1985), and contacting and drying the base paper with a cast drum.

The surface roughness of a base sheet was determined by the same method as described before. The center line average surface roughness Ra of base paper is preferably 3.0 μm or less. It is more preferably 2.0 μm or less, most preferably 1.5 μm or less. As to suitable methods to reduce the Ra of said paper to 3.0 μm or less, preferably 2.0 μm or less, more preferably 1.5 μm or less, reference may be made to the literature mentioned above.

However, although in a photographic support wherein the center line average surface roughness Ra of the front side resin layer surface is reduced to 1.0 μm or less simply by coating on a base paper a polyolefin resin layer comprising at least one layer as the front side resin layer of polyolefin resin-coated paper and using a smoothened paper as said base paper, the front side resin surface is less frizzy in appearance, is improved in smoothness and shows less development of pit-formed fine pores, it is not yet satisfactory in these points. Particularly, the development of pit-formed fine pores occurs persistently and is hardly reduced to a satisfactory level. Further, a marked development of such pores is observed when the application velocity in melt-extrusion coating of a resin layer on base paper reaches 100 m/min or more, particularly 150 m/min or more.

Now, it has been found that the development of pit-formed fine pores, which is more apt to occur on the front side resin surface, can be markedly prevented by adjusting, in the above-mentioned process for producing a polyolefin resin-coated paper according to the present invention, the linear pressure between a cooling roll and a back-up roll in extrusion coating of the front side resin layer to 30 to 200 kg/cm. Particularly, it has been found that the development of pit-formed fine pores can be very markedly prevented by coating, as the front side resin layer of resin-coated paper, at least two polyolefin resin layers consisting of an outermost resin layer incorporated with 9–20% by weight of titanium dioxide pigment and the other resin layer(s) by means of stepwise or simultaneous extrusion coating. Scarcely any development of pit-formed fine pores is now observed even at a coating velocity of resin layer of 150 m/min or more. The linear pressure between a cooling roll and a back-up roll in extrusion coating of resin layer necessary for markedly achieving the object of the present invention is in the range of 30–200 kg/cm, preferably 40 to 200 kg/cm, and most preferably 45–150 kg/cm. When the linear pressure is too low, the development of pit-formed fine pores cannot be prevented sufficiently. When it is too high, the resin surface of polyolefin resin-coated paper is poorly released from the cooling roll.

Although a natural pulp selected properly as described before is advantageously used as the pulp to constitute a base paper used in practicing the present invention, other materials than natural pulp including synthetic pulp and synthetic fibers may also be used as occasion demands. Natural pulps advantageously used are wood pulps including those of coniferous wood, broad-leaved wood, and the mixture thereof which have been subjected to conventional bleaching with chlorine, hypochlorites or chlorine dioxide, and alkali extraction or alkali treatment, and optionally oxidative bleaching with hydrogen peroxide, oxygen, etc., or a combination of these treatments. Various kinds of pulp may be used including kraft pulp, sulfite pulp, soda pulp, etc.

The base paper used in practicing the present invention may be incorporated with various sizing agents, high molecular compounds, and additives at the time of stock slurry preparation.

Sizing agents which may be favorably incorporated into the base paper used in practicing the present invention include, for example, metal salts of aliphatic acids and/or aliphatic acids, alkylketene dimers, alkenyl- or alkynylsuccinic anhydrides, epoxidized higher fatty acid amides disclosed in Japanese Patent Application Kokai (Laid-open) No. 54-147211 (1979), and organic fluorinated compounds disclosed in Japanese Patent Application Kokai (Laid-open) No. 56-109343 (1981).

Examples of sizing agents which may be advantageously incorporated into the base paper used in practicing the present invention include metal salts of aliphatic acids and/or aliphatic acids which are in a form capable of being fixed to pulp with the aid of water-soluble aluminum salts such as aluminum chloride, alumina sulfate, and polyaluminum chloride; and alkylketene dimers or combinational sizing agents of alkylketene dimers and epoxidized higher fatty acid amides which are in a from capable of being fixed to pulp with or without the use of water-soluble aluminum salts. The metal salt of aliphatic acid and/or aliphatic acid preferably has 12–22 carbon atoms. The amount thereof to be added is preferably in the range of 0.5–4.0% by weight based on the absolute dry weight of pulp. The proportion of a water-soluble aluminum salt optionally added is preferably in the range of 1/20 to 4/1, particularly preferably 1/10–1/1 in terms of solid weight relative to the sizing agent. The alkylketene dimer has an alkyl group of preferably 8–30 atoms, more preferably 12–18 atoms. Alkylketene dimers are available on the market as the emulsion thereof. Specific examples include Acquapel 360XC (mfd. by Dic-Hercules Chemicals Inc.). The amount thereof to be added is preferably 0.2–4.0% by weight in terms of net alkylketene dimer relative to the absolute dry weight of pulp.

High molecular compounds favorably incorporated into the base paper used in practicing the present invention during stock slurry preparation are, for example, cationic wet paper strength enhancing agents and cationic, anionic or amphoteric paper strength enhancing agents. A preferable cationic wet paper strength enhancing agent is polyamine-polyamide-epichlorohydrin resin. The amount thereof to be added is preferably in the range of 0.05–4.0% by weight, particularly 0.15–1.5% by weight, relative to the dry weight of pulp. Specific examples thereof include Kymene 557H, Kymene S-25, and Epi-nox P-130 (each manufactured by Dic-Hercules Chemicals Inc.).

Cationic, anionic or amphoteric paper strength enhancing agents may be, for example, cationated starch disclosed or exemplified in Japanese Patent Application Kokoku (Post-Exam. Publn.) No. 60-17103 (1985), cationic polyvinyl alcohol disclosed or exemplified in Japanese Patent Application No. 62-49699 (1987), cationic polyacrylamide disclosed or exemplified in Japanese Patent Application Kokai (Laid-Open) Nos. 57-185432 (1982) and 57-197539 (1982), anionic polyacrylamide disclosed or exemplified in Japanese Patent Application Kokoku (Post-Exam. Publn.) Nos. 62-23119 (1987) and 62-3118 (1987), amphoteric polyacrylamide disclosed or exemplified in Japanese Patent Application Kokoku (Post-Exam. Publn.) No. 61-37613 (1986) and Japanese Patent Application Kokai (Laid-Open) No. 59-31949 (1984), and vegetable galactomannan disclosed or exemplified in Japanese Patent Application Kokai (Laid-Open) No. 59-125731 (1984). The amount thereof to be added is preferably in the range of 0.05–8% by weight, particularly 0.15–4% by weight relative to the dry weight of pulp.

Various additives may be incorporated into the base paper used in practicing the present invention at the time of stock slurry preparation. Such additives may be fillers such as clay, kaolin, calcium carbonate, barium sulfate, magnesium silicate, and titanium oxide; pH adjusting agents such as sodium hydroxide and sodium carbonate; and coloring pigments, coloring dyes, and fluorescent brightness such as those disclosed or exemplified in Japanese Patent Application Kokai (Laid-Open) No. 54-147033 (1979) and Japanese Patent Application Nos. 62-37555 (1987) and No. 63-96516 (1988). These may be incorporated in suitable combinations thereof.

Various kinds of water-soluble polymers, antistatic agents, and additives may be incorporated into the base paper used in practicing the present invention by means of spraying or tub sizing press. Examples of water-soluble polymers include polymers derived from starch, polyvinyl alcohol, gelatin, polyacrylamide, or cellulose, disclosed or exemplified in Japanese Patent Application No. 63-96516 (1988). Examples of antistatic agents include alkali metal salts such as sodium chloride and potassium chloride, alkaline earth metal salts such as calcium chloride and barium chloride, and colloidal metal oxides such as colloidal silica, disclosed or exemplified in Japanese Patent Application No. 63-96516 (1988); and organic antistatic agents disclosed or exemplified in Japanese Patent Application Kokai (Laid-Open) No. 58-82242 (1983). Examples of latices and emulsions include petroleum resin emulsion and emulsions of styrene-acrylic acid-acrylic ester copolymer, styrene-acrylic acid-butadiene copolymer, ethylene-vinyl acetate copolymer and styrene-maleic acid-acrylic ester copolymer. Examples of pigments include clay, kaolin, talc, barium sulfate and titanium oxide. Examples of pH adjusting agents include hydrochloric acid, phosphoric acid, citric acid, sodium hydroxide, and sodium carbonate. They may be advantageously used in suitable combinations thereof and optionally in combinations with above-mentioned additives including coloring pigments, coloring dyes and fluorescent brightness.

The base paper used in practicing the present invention may be produced by using such conventional papermaking machines as Fourdrinier paper machines and cylinder paper machines. It is advantageous to use an appropriate papermaking process disclosed or exemplified in Japanese Patent Application Kokai (Laid-open) Nos. 58-37642 (1983), 61-260240 (1986) and 61-284762 (1986). Although the paper is not specifically restricted as to its thickness, it is preferably subjected to calendering subsequently to papermaking as disclosed or exemplified in Japanese Patent Application Kokai (Laid-Open) Nos. 58-37642 (1983) and 60-126397 (1985) and preferably has a basis weight of 40–250 g/m$^2$.

Polyolefin resins usable in practicing the present invention include homopolymers of olefins such as low density polyethylene, high density polyethylene, polypropylene, polybutene, and polypentene, copolymers of two or more olefins such as ethylene-propylene copolymer, and mixtures thereof. These polymers of various densities and melt indexes can be used each alone or as mixtures thereof. When the resin layer is of a multilayer structure, resins having different properties, for example a resin having a melt index (hereinafter abbreviated as "MI") of 5–20 for the outermost layer and another resin having a MI of 2–10 for the lower layer(s), may be used.

The front side resin layer of the photographic support of the present invention contains 9–20% by weight of titanium dioxide incorporated therein. In a resin-coated paper of a multi-layer structure, the lower resin layer is allowed either to be incorporated or not to be incorporated with titanium dioxide. Further, it is advisable to add into the polyolefin resin various kinds of additives in suitable combinations, which include white pigments such as zinc oxide, talc, and calcium carbonate; aliphatic acid amide such as stearic acid amide and arachidic acid amide; metal salts of aliphatic acids such as zinc stearate, calcium stearate, aluminum stearate, magnesium stearate, zirconium octylate, sodium palmitate, calcium palmitate, and sodium laurate; antioxidants such as tetrakis[methylene-3(3,5-di-tert-butyl-4-hydroxyphenyl)propionate]methane and 2,6-di-tert-butyl-4-methylphenol; blue pigments and dyes such as cobalt blue, Prussian blue, ultramarine blue, cerulean blue, and phthalocyanine blue; magenta pigments and dyes such as cobalt violet, Fast violet and manganese violet; fluorescent brightness such as bis(tert-butyl-benzoxazole)-thiophene and bis(methylbenzoxazol)naphthalene; and ultraviolet absorbers such as Tinuvin 320, Tinuvin 326 and Tinuvin 328 (respectively a trade name by Ciba-Geigy Corp.).

The photographic support obtained by the process of the present invention is produced by so-called extrusion coating, which comprises casting a heated and molten polyolefin resin on a travelling base paper, and its both sides are coated with resin. In said coating process, when the resin layer is of a multi-layer structure, it is preferable to use a so-called tandem extrusion system, in which the outermost resin layer and the inner resin layer(s) of the front side of the photographic support are extrusion-coated stempwise or preferably continuously, or a so-called coextrusion coating system, in which the outermost resin layer and the inner resin layer(s) are extrusion-coated simultaneously in a multi-layer. The base paper is preferably subjected to an activation treatment, e.g. corona discharge treatment, flame treatment, etc., before being coated with polyolefin resin. The emulsion side surface of a photographic support is a glossy surface or a very finely matted surface described in Japanese Patent Application Kokai (Laid-Open) No. 55-26507 (1980), mat surface, silky surface, etc. of such a surface texture that when the paper is made into photographic printing paper, the surface gloss of the resulting photographic paper is not affected by the texture, while the back side surface is usually lusterless. The front surface, or optionally both the front and the back surfaces, may be subjected to an activation treatment, e.g. corona discharge treatment or flame treatment. Further, after the activation treatment, under coating may be applied as described in Japanese Patent Application Kokai (Laid-open) No. 61-84643 (1986). Though the resin layer of the back side of resin-coated paper is not specifically restricted as to its thickness, it is advantageously extrusion-coated generally in a thickness of about 10–50 μm.

The photographic support according to the present invention can be provided with various back coating layers coated thereon to prevent electrification, curling, etc. The back coating layer may contain inorganic antistatic agents, organic antistatic agents, hydrophilic binders, latices, hardening agents, pigments, surface active agents, etc., disclosed or exemplified in Japanese Patent Application Kokoku (Post-Exam. Publn.) Nos. 52-18020 (1977), 57-9059 (1982), 57-53940 (1982), and 58-56859 (1983), and Japanese Patent Application Kokai (Laid-Open) Nos. 59-214849 (1984) and 58-184,144 (1983), incorporated thereinto in suitable combinations thereof.

The photographic support according to the present invention can be used, after provided with various photographic constituting layers coated thereon, for various uses including color photographic printing paper, black-and-white photographic printing paper, phototypographic printing paper, photocopying paper, reverse photographic materials, negatives and positives for silver salt diffusion transcription process, and printing materials. For example, emulsion layers of silver chloride, silver bromide, silver chlorobromide, silver iodobromide, or silver chloroiodobromide can be provided. Further, multi-layer structure silver halide layers can be provided by incorporating a color coupler into silver halide photographic emulsion layers. Silver salt diffusion transcription image-receiving layers can be provided by incorporation of physical development nuclei thereinto. The binder to be used in these photographic constituting layers may be, besides commonly used gelatin, hydrophilic high molecular substances such as polyvinylpyrrolidone, polyvinyl alcohol, and sulfuric acid esters of polysaccharides. Further, the above-mentioned photographic constituting layers may be incorporated with various additives. For example, cyanine dyes, merocyanine dyes, etc. as a sensitizing agent; water-soluble gold compounds and sulfur compounds, etc. as a chemical sensitizer; hydroxytriazolopyrimidine compounds, mercapto-heterocyclic compounds, etc. as an anti-fogging agent or stabilizer; formalin, vinyl-sulfone compounds, aziridine compounds, etc. as a hardening agent; benzenesulfonic acid salts, sulfosuccinic acid ester salts, etc. as a coating assistants; dialkylhydroquinone compounds, etc. as an anti-staining agent; and further fluorescent brightness, sharpness improving dyes, antistatic agents, pH adjusting agents, fogging agents; and further, at the time of formation and dispersion of silver halides, water-soluble iridium compounds, water soluble rhodium compounds, etc. may be incorporated in suitable combinations thereof.

The silver halide photographic materials according to the present invention is subjected to such treatments of exposure, development, stopping, fixing, bleaching, stabilization, etc. adapted to the individual photographic materials, as described in "Shashin Kanko Zairyo To Toriatsukaiho (Photographic sensitive materials and methods of treatment thereof)" [Shashin Gijutsu Koza (Course of Photographic Technologies) 2, written by Goro Miyamoto, edited by Kyoritsu Shuppan]. In particular, multi-layer silver halide color photographic materials which are subjected to monobath bleaching-developing treatment succeedingly to color development, can be treated with color developing solution containing any main developers including CD-III, CD-IV (these two being trade names by Eastman Kodak Co.), Droxychrom (a trade name by May and Baker Chemical Co.) and the like. The developing solutions containing such main developers may further contain development accelerators such as benzyl alcohol, thallium salts, phenidone, etc. Developing solutions containing substantially no benzyl alcohol can also be used. Preferred monobath bleacher-fixers are solutions of metal salts of aminopolycarboxylic acids (for example, ferric complex salts of ethylenediaminetetraacetic acid, propylenediaminetetraacetic acid, etc.) and preferred fixing agents are sodium thiosulfate, ammonium thiosulfate, etc. Such monobath bleaching-fixing solutions may be incorporated with various additives. For example, desilverization accelerators (e.g. mercaptocarboxylic acids disclosed in U.S. Pat. No. 3,512,979, mercapto-heterocyclic compounds disclosed in Berg. P. 682,426, etc.), anti-staining agents, pH adjusting or buffering agents, hardening agents (e.g., magnesium sulfate, aluminum sulfate, potassium alum, etc.), surface active agents, and so forth may be incorporated therein in suitable combinations thereof. Such monobath bleaching-fixing solution may be used at various pH. A preferable range of pH is 6.0–8.0.

The present invention will be described further in detail below with reference to Examples.

EXAMPLE 1

A mixed stock comprising 50 parts by weight of broad-leaved wood bleached kraft pulp and 50 parts by weight of coniferous wood sulfite pulp was beaten to a Canadian Standard freeness 310 ml and made into a paper of 170 g/m$^2$ according to the following recipe (the values in the recipe are indicated in part by weight).

| | |
|---|---|
| Pulp | 100 parts |
| Blue dye | 0.00005 part |
| Bis(triazinylamino)stilbensulfonic acid-type fluorescent brightner | 0.15 part |
| Polyacrylamide (Stargum A-15, mfd. by Seiko Kagaku K.K.) | 3.0 parts |
| $AlCl_3$ | 0.7 part |
| Stock pH is adjusted to 6.0 with sodium hydroxide. | |
| Alkylketene dimer emulsion (as net ketene dimer) | 0.4 part |
| Polyamine-polyamide-epichlorohydrin resin | 0.4 part |

The wet paper thus obtained was dried on a heating plate of 110° C.

The resulting paper was impregnated with 30 g/m$^2$ of an impregnation liquid of the following composition and then dried in a hot air dryer at 110° C. (the values in the composition are indicated in parts by weight).

| | |
|---|---|
| Carboxy-modified polyvinyl alcohol | 4.0 parts |
| Bis(triazinylamino)stilbenesulfonic acid-type fluorescent brightener | 0.05 part |
| Blue dye | 0.002 part |
| Sodium chloride | 3.5 parts |
| Total amount including water | 100 parts |

The impregnated and dried paper was calendered at a linear pressure of 90 kg/cm or 20 kg/cm and then its both sides were subjected to corona treatment. Then, the back surface was coated by use of a coater with a 1:1 mixture of high density polyethylene (density: 0.96 g/cm$^3$, MI: 5) and low density polyethylene (density: 0.92 g/cm$^3$, MI: 5) melt-extruded at a resin temperature of 330° C. in a thickness of 30 μm. Succeedingly, the front surface was coated by use of a coater with a resin composition composed in a ratio of 7:3 of low density polyethylene (density: 0.92 g/cm$^3$, MI: 5, before pigment addition) and high density polyethylene (density: 0.96 g/cm$^3$, MI: 5, before pigment addition) and containing 10% by weight of anatase-type titanium oxide and 0.5% by weight of zinc stearate, a dispersing agent for the former, melt-extruded at a resin temperature of 330° C. in a thickness of 30 μm. During the coating, the linear pressure between a mirror-finished cooling roll and a back-up roll was varied as shown in Table 1.

Separately, the front side surface was coated with polyethylene resin compositions as follows. First, low density polyethylene (density: 0.92 g/cm$^3$, MI: 5) was melt-extruded at a resin temperature of 330° C. and coated with a coater in a thickness of 12.5 μm under a linear pressure between a mirror-finished cooling roll and a back-up roll of 35 kg/cm. Successively thereon, a resin composition composed in a ratio of 7:3 of low density polyethylene (density: 0.92 g/cm$^3$, MI: 5, before pigment addition) and high density polyethylene (density: 0.96 g/cm$^3$, MI: 5, before pigment addition) and containing 10% by weight of anatase-type titanium dioxide and 0.5% by weight of zinc stearate, a dispersing agent for the former, was melt-extruded at a resin temperature of 305° C. and coated with a coater in a thickness of 17.5 μm under a linear pressure between a mirror-finished cooling roll and a back-up roll varied as shown in FIG. 1.

The polyethylene resin-coated paper having a specular surface thus obtained was examined for development of crater-formed fine pores on the specular surface by the following method. A 1 cm square portion of the polyethylene resin-coated paper surface was enlarged 20 times and observed to count the number of pores having a diameter of 1 mm (actual diameter 50 μm) or more. The average number of pores in 10 fields was taken as the measure for evaluating the degree of development of crater-formed fine pores.

When the average number is large, such problems in appearance as lowering of gloss and development of mat surface arise when the paper is finished into a photographic paper print.

The results thus obtained are shown in Table 1.

TABLE 1

| Classification(1) | Sample No. | Base paper | Resin layer structure | Press pressure (kg/cm)(2) | Center line average surface roughness Ra (μm) | Number of fine pores |
|---|---|---|---|---|---|---|
| | 1 | ↑ | Single layer | 25 | 0.61 | 31 |
| (C) | 2 | | Single layer | 30 | 0.60 | 25 |
| (C) | 3 | | Single layer | 40 | 0.59 | 20 |
| (B) | 4 | Base paper Ra: 1.71 m | Single layer | 50 | 0.58 | 15 |
| (B) | 5 | | Single layer | 100 | 0.55 | 7 |
| (B) | 6 | Calendering | Single layer | 150 | 0.53 | 6 |
| | 7 | | Single layer | 25 | 0.60 | 12 |
| (B) | 8 | (linear pressure: | Multi-layer | 30 | 0.59 | 7 |
| (B) | 9 | 90 kg/cm) | Multi-layer | 40 | 0.59 | 5 |
| (A) | 10 | | Multi-layer | 50 | 0.58 | 4 |
| (A) | 11 | | Multi-layer | 100 | 0.56 | 2 |
| (A) | 12 | ↓ | Multi-layer | 150 | 0.52 | <1 |
| | 13 | ↑ | Single layer | 25 | 1.06 | 69 |
| | 14 | | Single layer | 40 | 1.04 | 46 |
| | 15 | Base paper Ra: 2.85 μm | Single layer | 50 | 1.03 | 34 |
| (C) | 16 | | Single layer | 100 | 1.00 | 16 |
| (C) | 17 | Calendering | Single layer | | | |
| | 18 | (Linear pressure: | Multi-layer | | | |
| | 19 | 20 kg/cm) | Multi-layer | | | |
| | 20 | | Multi-layer | | | |
| (B) | 21 | | Multi-layer | | | |
| (B) | 22 | ↓ | Multi-layer | | | |

TABLE 1-continued

| | | |
|---|---|---|
| 150 | 0.96 | 8 |
| 25 | 1.04 | 38 |
| 40 | 1.02 | 23 |
| 50 | 1.01 | 18 |
| 100 | 0.98 | 8 |
| 150 | 0.95 | 6 |

Note
(1)No symbol: outside the present invention;
(A): the present invention in the most preferred embodiment
(B): the present invention in preferred embodiments
(C): the present invention.
(2)Linear pressure between cooling roll and back-up roll in melt-extrusion of front side resin layer.

Table 1 clearly reveals that the samples obtained according to the present invention (Nos. 2–6, Nos. 8–12, Nos. 16–17, Nos. 21–22) wherein the center line average surface roughness of the front side resin layer surface of the resin-coated paper is 1.0 μm or less and the linear pressure between a cooling roll and a back-up roll in melt-extrusion coating of polyolefin resin is 40 kg/cm or more give a smaller number of crater-formed fine pores and hence are superior to the other samples outside the scope of the present invention (No. 1, No. 7, Nos. 13–15, Nos. 18–20). Among them, the samples wherein the front side resin layer has a multi-layer structure (Nos. 10–12, Nos. 21–22) are more excellent, showing less development of crater-formed fine pores, than the samples of single layer structure (Nos. 2–6, Nos. 16–17). In particular, it is revealed that the samples prepared in the most preferred embodiments of the present invention wherein the front side resin layer has a multi-layer structure and the center line average surface roughness Ra is 0.6 μm or less (Nos. 10–12) show markedly low degree of development of crater-formed fine pores and hence are highly excellent as a photographic support.

Further, multi-layer silver halide color photographic printing papers comprising respective polyethylene resin-coated paper as the support were prepared and examined for the sharpness of yellow, magenta and cyan images. No difference was observed between the samples according to the present invention and the samples outside the scope of the present invention.

EXAMPLE 2

Base paper calendered at a linear pressure of 90 kg/cm was prepared in the same manner as in Example 1 except for using the following recipe in place of the recipe for base paper used in Example 1.

| | |
|---|---|
| Pulp | 100 parts |
| Blue dye | 0.00005 part |
| Bis(triazinylamino)stilbenesulfonic acid-type fluorescent brightener | 0.15 part |
| Cationated starch (Cato F, mfd. by Oji-National K.K.) | 3.0 parts |
| Alumina sulfate | 1.0 part |
| Aliphatic acid soap | 1.0 part |
| Polyamine-polyamide-epichlorohydrin resin | 0.4 part |

Then, the both sides of the base paper were subjected to a corona discharge treatment and the back surface was coated by use of a coater with a 1:1 mixture of high density polyethylene (density: 0.96 g/cm$^3$, MI: 5) and low density polyethylene (density: 0.92 g/cm$^3$, MI: 5) melt-extruded at a resin temperature of 330° C. in a thickness of 30 μm. Thereafter, the front surface of the base paper was coated by double layer coextrusion coating using the following two kinds of polyethylene compositions. The polyethylene resin composition coated as the lower layer adjacent to the base paper was low density polyethylene (density: 0.92 g/cm$^3$, MI: 5) and had a thickness of 12.5 μm. The polyethylene composition coated thereon as the upper layer was a mixture comprising low density polyethylene (density: 0.92 g/cm$^3$, MI: 5, before pigment addition) and high density polyethylene (density: 0.96 g/cm$^3$, MI: 5, before pigment addition) in a ratio of 7:3 and containing 10% by weight of rutile-type titanium oxide, 0.5% by weight of zinc stearate, a dispersing agent for the former, and 150 ppm of tetrakis[methylene-3(3,5-di-tert-butyl-4-hydroxyphenyl)propionate]methane and had a thickness of 17.5 μm. The two resin compositions were coated by use of a double layer coextrusion coater at a lower resin temperature of 320° C. and an upper layer resin temperature of 310° C. under a linear pressure between a mirror-finished cooling roll and a back-up roll of 100 kg/cm to prepare a photographic polyethylene resin-coated paper.

The polyethylene resin-coated paper thus obtained showed a center line average surface roughness Ra of the front side resin surface of 0.58 μm, very low degree of crater-formed fine pore development, and was thus an excellent photographic support.

According to the present invention, crater-formed fine pores can be prevented from developing on the resin surface of the side to be coated with an emulsion of a resin-coated paper comprising base paper and polyolefin resin coating applied to the both sides thereof, and hence an excellent photographic support of a good surface smoothness and an excellent photographic printing paper of a good surface smoothness having said support can be provided.

What is claimed is:

1. A process for producing a photographic support which comprises coating one side of a base sheet with a molten polyolefin resin, coating another side of the base sheet with a molten polyolefin resin, and passing the resulting resin coated base sheet between a cooling roll and a back-up roll under a linear pressure of 30 to 200 kg/cm, a front side of the base sheet on which a photographic emulsion layer is to be formed being coated with at least one polyolefin resin layer, and an outermost polyolefin resin layer having a center line average surface roughness Ra of 1.0 μm or less.

2. A process according to claim 1, wherein the base sheet has a center line average surface roughness of 3.0 μm or less.

3. A process according to claim 1, wherein the base sheet has a center line average surface roughness of 2.0 μm or less.

4. A process according to claim 1, wherein the front side of the sheet on which a photographic emulsion layer is to be formed is coated with at least two polyolefin layers stepwise or simultaneously, and the outermost polyolefin layer contains 9 to 20% by weight of titanium dioxide as a pigment.

5. A process according to claim 1, wherein the linear pressure between the cooling roll and the back-up roll is 40 to 200 kg/cm.

6. A process according to claim 7, wherein the linear pressure between the cooling roll and the back-up roll is 45 to 150 kg/cm.

7. A process according to claim 1, wherein the photographic support has a center line average surface roughness of 0.8 μm or less.

* * * * *